US011186901B2

(12) United States Patent
Amada et al.

(10) Patent No.: US 11,186,901 B2
(45) Date of Patent: Nov. 30, 2021

(54) CHISEL AND STEEL FOR CHISEL

(71) Applicant: KOMATSU LTD., Tokyo (JP)

(72) Inventors: Eiji Amada, Kyotanabe (JP); Akihiro Ochiai, Hirakata (JP); Norimasa Tsunekage, Himeji (JP); Yuko Nagaki, Himeji (JP)

(73) Assignee: KOMATSU LTD., Tokyo (JP)

( * ) Notice: Subject to any disclaimer, the term of this patent is extended or adjusted under 35 U.S.C. 154(b) by 448 days.

(21) Appl. No.: 15/566,195

(22) PCT Filed: Mar. 9, 2016

(86) PCT No.: PCT/JP2016/057370
§ 371 (c)(1),
(2) Date: Oct. 12, 2017

(87) PCT Pub. No.: WO2016/170866
PCT Pub. Date: Oct. 27, 2016

(65) Prior Publication Data

US 2018/0087137 A1 Mar. 29, 2018

(30) Foreign Application Priority Data

Apr. 21, 2015 (JP) ..... JP2015-086460

(51) Int. Cl.
*C22C 38/00* (2006.01)
*C22C 38/22* (2006.01)
(Continued)

(52) U.S. Cl.
CPC ..... *C22C 38/22* (2013.01); *B25D 17/02* (2013.01); *C22C 38/00* (2013.01); *C22C 38/02* (2013.01);
(Continued)

(58) Field of Classification Search
CPC ..... C22C 38/00
See application file for complete search history.

(56) References Cited

U.S. PATENT DOCUMENTS 1,468,937 A * 9/1923 Armstrong ..... C22C 38/22 420/114
2015/0259771 A1* 9/2015 Vartanov ..... C21D 9/32 148/318

FOREIGN PATENT DOCUMENTS

GB 641302 A * 8/1950 ..... C22C 38/18
JP S60-33339 A 2/1985
(Continued)

OTHER PUBLICATIONS

English translation of JP 2008-248282 A of Ozawa courtesy of patentscope (Year: 2008).*
(Continued)

*Primary Examiner* — Jophy S. Koshy
(74) *Attorney, Agent, or Firm* — Oliff PLC

(57) ABSTRACT

A steel constituting a chisel according to the present invention includes: 0.40-0.45% by mass of carbon, 0.50-0.80% by mass of silicon, 1.00-1.30% by mass of manganese, 0.001-0.005% by mass of sulfur, 2.90-3.80% by mass of chromium, and 0.20-0.40% by mass of molybdenum, with a balance consisting of iron and an unavoidable impurity, the steel has an ideal critical diameter DI defined by Equation (1) of 600 or more:

$$DI=7\cdot(\%\ C)^{1/2}\cdot(1+0.64\cdot\%\ Si)\cdot(1+4.1\cdot\%\ Mn)\cdot(1+2.83\cdot\%\ P)\cdot(1-0.62\cdot\%\ S)\cdot(1+2.33\cdot\%\ Cr)\cdot(1+3.14\cdot\%\ Mo) \quad (1).$$

15 Claims, 3 Drawing Sheets

(51) Int. Cl.

| | |
|---|---|
| ***B25D 17/02*** | (2006.01) |
| ***E21C 37/26*** | (2006.01) |
| ***E21B 10/52*** | (2006.01) |
| ***C22C 38/02*** | (2006.01) |
| ***C22C 38/04*** | (2006.01) |

(52) U.S. Cl.
CPC ..... *C22C 38/04* (2013.01); *E21B 10/52* (2013.01); *E21C 37/26* (2013.01); *B25D 2222/42* (2013.01)

(56) References Cited

FOREIGN PATENT DOCUMENTS

| | | | | |
|---|---|---|---|---|
| JP | H02-050911 | A | 2/1990 | |
| JP | H05-214485 | A | 8/1993 | |
| JP | H05-263180 | A | 10/1993 | |
| JP | H08-199287 | A | 8/1996 | |
| JP | H11-131193 | A | 5/1999 | |
| JP | 2008248282 | A * | 10/2008 | ..... C22C 38/00 |

OTHER PUBLICATIONS

Bramfitt, Bruce L., and Arlan O. Benscoter. (2002) "Metallographer's Guide." Practices and Procedures for Irons and Steels, ASM International, Materials Park, OH, USA 87, No. 3. (Year: 2002).*

Chengkang, Yan et al., "The Effect of Chromium on the Hardness and Toughness of Wear-Resistant Medium Carbon Alloy Steels", Dalian, China: Dalian Railway Institute, Jul. 1997, pp. 35-37.

Jimei, Xiao, "Metal Material Science Principle and Application", Baotou, The Inner Mongolia Autonomous Region, China: Science & Technology of Baotou Steel Editorial Department, Oct. 1996, pp. 123-124.

May 31, 2016 International Search Report issued in International Patent Application No. PCT/JP2016/057370.

Gao, G et al. "Common Materials Used in Electrical Power Engineering" China Electric Power Press, pp. 20-30, Dec. 1994.

* cited by examiner

CHISEL AND STEEL FOR CHISEL

TECHNICAL FIELD

The present invention relates to a chisel and a steel for a chisel.

BACKGROUND ART

A hydraulic breaker is attached to the front end of an arm of a work machine, and is used for crushing rocks, concretes, furnace walls, steelmaking slag, and so forth. The hydraulic breaker has a chisel that is axially driven by a piston and crushes rocks or the like. To reduce abrasion caused by contact with hard rocks or the like, high abrasion resistance is required for a material (steel) constituting the chisel. The chisel, which is a rod-shaped member, might be broken by an impact generated by crushing rocks or the like. From the viewpoint of reducing breakage, high toughness is also required for the steel constituting the chisel. There has been proposed a steel for a chisel whose composition is adjusted in order to obtain both abrasion resistance and toughness (see, for example, Japanese Patent Application Laid-Open No. H5-214485 (Patent Literature 1), Japanese Patent Application Laid-Open No. H8-199287 (Patent Literature 2), and Japanese Patent Application Laid-Open No. H11-131193 (Patent Literature 3)).

CITATION LIST

Patent Literature

Patent Literature 1: Japanese Patent Application Laid-Open No. H5-214485

Patent Literature 2: Japanese Patent Application Laid-Open No. H8-199287

Patent Literature 3: Japanese Patent Application Laid-Open No. H11-131193

SUMMARY OF INVENTION

Technical Problem

Hydraulic breakers have been used in more and more severe conditions, and enhancement of durability is required for chisels. Thus, a steel for a chisel that can further enhance durability of the chisel is needed.

The present invention has been made in order to meet such a requirement, and has an object of providing a steel for a chisel and a chisel that can achieve enhanced durability.

Solution to Problem

A steel for a chisel according to the present invention is a steel to be used as a material constituting a chisel. The steel for a chisel includes: 0.40% by mass or more and 0.45% by mass or less of carbon, 0.50% by mass or more and 0.80% by mass or less of silicon, 1.00% by mass or more and 1.30% by mass or less of manganese, 0.001% by mass or more and 0.005% by mass or less of sulfur, 2.90% by mass or more and 3.80% by mass or less of chromium, and 0.20% by mass or more and 0.40% by mass or less of molybdenum, with a balance consisting of iron and an unavoidable impurity. An ideal critical diameter DI defined by Equation (1) is 600 or more:

$$DI=7\cdot(\%\ C)^{1/2}\cdot(1+0.64\cdot\%\ Si)\cdot(1+4.1\cdot\%\ Mn)\cdot(1+2.83\cdot\%\ P)\cdot(1-0.62\cdot\%\ S)\cdot(1+2.33\cdot\%\ Cr)\cdot(1+3.14\cdot\%\ Mo) \quad (1).$$

Inventors of the present invention conducted investigations regarding the way of enhancing durability of a chisel. The inventors focused on a phenomenon that a chisel is damaged by cracking as well as abrasion and breakage due to contact with rocks or the like. Cracking is different from breakage in which a chisel is broken by an impact, and is a damage in which the front end and its vicinity of a chisel become chipped. Unlike breakage, cracking is not damage at such a degree that a chisel immediately becomes out of use, but causes a chisel to be damaged substantially to the same degree as a state in which the front end of the chisel is rapidly abraded. According to investigations of the inventors, these cracking and abrasion are causal factors of damage of a chisel that is used under severe environments.

In a chisel to be used under severe environments, the temperature of the front end of the chisel increases to about 600° C. in crushing rocks or the like. Here, abrasion resistance can be increased by increasing hardness. The hardness of a steel decreases as the temperature increases. Thus, abrasion of the chisel can be suppressed by increasing the hardness at a high temperature of about 600° C. In general, the hardness of a steel at a high temperature has a one-to-one relationship with the hardness of a steel tempered at this high temperature. Thus, the abrasion resistance of a material for a chisel to be used in severe environments can be evaluated based on a hardness at room temperature after tempering at a high temperature (600° C.).

On the other hand, cracking occurs at a relatively low temperature at which the impact value of a chisel decreases. Cracking of a chisel to be used in severe environments occurs in a state in which the front end of the chisel becomes a high temperature (about 600° C.) when being used, is temporarily cooled, and then is used again. Thus, the cracking resistance of a material for a chisel to be used in severe environments can be evaluated based on an impact value at room temperature after tempering at a high temperature (600° C.).

In addition, a hardness distribution in a radial direction is also important for a chisel to be used in severe environments. In particular, in a large-size chisel (e.g., a chisel whose diameter exceeds 150 mm), it can be difficult to sufficiently harden the chisel by quenching from a surface portion to a core portion (a radially center portion) because of a relationship with hardenability of a steel constituting the chisel. In a case where a region sufficiently hardened by quenching is limited to a surface portion, a portion insufficiently hardened by quenching is exposed by abrasion of the surface portion, for example. In this case, abrasion rapidly proceeds. For this reason, it is also important to obtain sufficient hardenability in a steel for a chisel constituting a chisel to be used in severe environments.

That is, according to investigations of the inventors, it is possible to obtain a steel for a chisel preferable as a material to be used under severe environments by increasing an impact value while maintaining high hardness at room temperature after tempering at a high temperature (600° C.) and also by obtaining sufficient hardenability.

Based on the findings described above, the inventors set a hardness of 32 HRC or more and an impact value of 80 J/cm$^2$ or more at room temperature after tempering at 600° C., and a hardness of 45 HRC in the core portion after tempering at 210° C. as target values in consideration of abrasion resistance, cracking resistance, and hardness in a core portion required for a chisel in actual use environments.

Compositions of a steel capable of obtaining the target value were examined. As a result, it is found that a steel having the composition described above can achieve the target value, which has led to the present invention. That is, a hardness of a core portion at 45 HRC or more can be obtained by performing a quenching and tempering process on a steel adjusted to have the composition described above of carbon, silicon, manganese, sulfur, chromium, molybdenum, and phosphorus included as an impurity. In anticipation of use environments, in a state subjected to further tempering at 600° C., a hardness at room temperature of 32 HRC or more and an impact value of 80 J/cm$^2$ or more can be obtained. In this manner, the steel for a chisel according to the present invention can enhance durability.

In the steel for a chisel, a DI value defined by Equation (1) is 600 or more. A proportion of a martensitic structure in a core portion of a steel material (rod steel) having a diameter exceeding 150 mm is set at 90% or more by oil quenching, and thereby, a sufficient hardness of a core portion can be obtained even for a large-size chisel. From the viewpoint of achieving this, the DI value needs to be 600 or more.

$$DI=7\cdot(\%\ C)^{1/2}\cdot(1+0.64\cdot\%\ Si)\cdot(1+4.1\cdot\%\ Mn)\cdot(1+2.83\%\ P)\cdot(1-0.62\cdot\%\ S)\cdot(1+2.33\cdot\%\ Cr)\cdot(1+3.14\cdot\%\ Mo) \quad (1)$$

In the steel for a chisel, a value of $\alpha$ defined by Equation (2) may be 2.0 or more and 2.4 or less. In this case, high levels of the hardness and the impact value after high-temperature tempering can be obtained, and durability of the chisel can be further enhanced.

$$\alpha=5\cdot\%\ C+3\cdot\%\ Si+\%\ Mo-2\cdot\%\ Mn-10\cdot\%\ S \quad (2)$$

In Equations (1) and (2), % C, % Si, % Mn, % P, % S, % Cr, and % Mo respectively indicate numerical values when carbon, silicon, manganese, phosphorus, sulfur, chromium, and molybdenum in the steel are represented by % by mass. Phosphorus is included in the steel as an impurity.

A chisel according to the present invention is constituted by a steel containing 0.40% by mass or more and 0.45% by mass or less of carbon, 0.50% by mass or more and 0.80% by mass or less of silicon, 1.00% by mass or more and 1.30% by mass or less of manganese, 0.001% by mass or more and 0.005% by mass or less of sulfur, 2.90% by mass or more and 3.80% by mass or less of chromium, and 0.20% by mass or more and 0.40% by mass or less of molybdenum, with a balance consisting of iron and an unavoidable impurity, wherein an ideal critical diameter DI defined by Equation (1) is 600 or more.

In the chisel, a value of $\alpha$ defined by Equation (2) may be 2.0 or more and 2.4 or less.

By employing the steel for a chisel according to the present invention as a material constituting a chisel, both high abrasion resistance and high cracking resistance can be obtained. As a result, a chisel having high durability can be provided.

In the chisel, a hardness of a surface at room temperature after heating to 600° C. may be 32 HRC or more, and a region including the surface may have an impact value of 80 J/cm$^2$ or more. In this case, a chisel having high durability can be provided.

In the chisel, a core portion may have a hardness of 45 HRC or more. In this case, a chisel having higher durability can be provided.

Here, it will be described why the composition of the steel is limited to the range described above.

Carbon: 0.40% by Mass or More and 0.45% by Mass or Less

Carbon is an element that significantly affects hardness of a steel. If the carbon content is less than 0.40% by mass, it is difficult to obtain hardness at high temperatures necessary for obtaining sufficient abrasion resistance. On the other hand, if the carbon content exceeds 0.45% by mass, toughness decreases, and it becomes difficult to obtain an impact value at high temperatures necessary for obtaining sufficient cracking resistance. Thus, the carbon content needs to be limited to the range described above.

Silicon: 0.50% by Mass or More and 0.80% by Mass or Less

Silicon is an element that shows a deoxidation effect in a steelmaking process as well as the effects of enhancing hardenability of a steel, strength of the matrix of a steel, and resistance to temper softening, for example. If the silicon content is less than 0.50% by mass, these advantages cannot be sufficiently obtained. On the other hand, if the silicon content exceeds 0.80% by mass, the impact value after high-temperature tempering tends to decrease. For these reasons, the silicon content needs to be within the range described above. The silicon content is preferably 0.60% by mass or more.

Manganese: 1.00% by Mass or More and 1.30% by Mass or Less

Manganese is an element that is effective for enhancing hardenability of a steel and has a deoxidation effect in a steelmaking process. From the viewpoint of enabling hardening of a chisel from the surface to a core portion in quenching, the manganese content needs to be 1.00% by mass or more. On the other hand, if the manganese content exceeds 1.30% by mass, segregation in grain boundary of manganese might be conspicuous. Thus, the manganese content needs to be 1.30% by mass or less. The manganese content is preferably 1.20% by mass or less.

Sulfur: 0.001% by Mass or More and 0.005% by Mass or Less

Sulfur is an element that enhances machinability of a steel. Sulfur is also an element that is mixed during a steelmaking process even if not added intentionally. If the sulfur content is less than 0.001% by mass, production costs of a steel increases. On the other hand, according to investigations of the inventors, in the composition of the steel for a chisel according to the present invention, the sulfur content significantly affects the impact value after high-temperature tempering, that is, cracking resistance. If the sulfur content exceeds 0.005% by mass, it is difficult to increase the impact value after high-temperature tempering to 80 J/cm$^2$ or more. Thus, while a certain degree of decrease in machinability is permitted, the sulfur content needs to be 0.005% by mass or less. By reducing the sulfur content to 0.004% by mass or less, the impact value after high-temperature tempering can be further increased.

Chromium: 2.90% by Mass or More and 3.80% by Mass or Less

Chromium enhances hardenability of a steel. From the viewpoint of enabling hardening of a chisel from the surface to a core portion in quenching, the chromium content needs to be 2.90% by mass or more. On the other hand, an excessive addition of chromium might cause quench crack. From the viewpoint of avoiding quench crack, the chromium content needs to be 3.80% by mass or less. The chromium content is preferably 3.60% by mass or less.

Molybdenum: 0.20% by Mass or More and 0.40% by Mass or Less

Molybdenum enhances hardenability and increases resistance to temper softening. Molybdenum also has the function of improving high-temperature temper brittleness. If the molybdenum content is less than 0.20% by mass, these advantages are not sufficiently exhibited. On the other hand, if the molybdenum content exceeds 0.40% by mass, the advantages described above are saturated. Thus, the molybdenum content needs to be within the range described above. By reducing the molybdenum content to 0.35% by mass or less, fabrication costs of a steel can be reduced.

Effects of Invention

As is clear from the above description, the present invention can provide a steel for a chisel and a chisel that can achieve enhanced durability.

DESCRIPTION OF EMBODIMENTS

Figure 1:
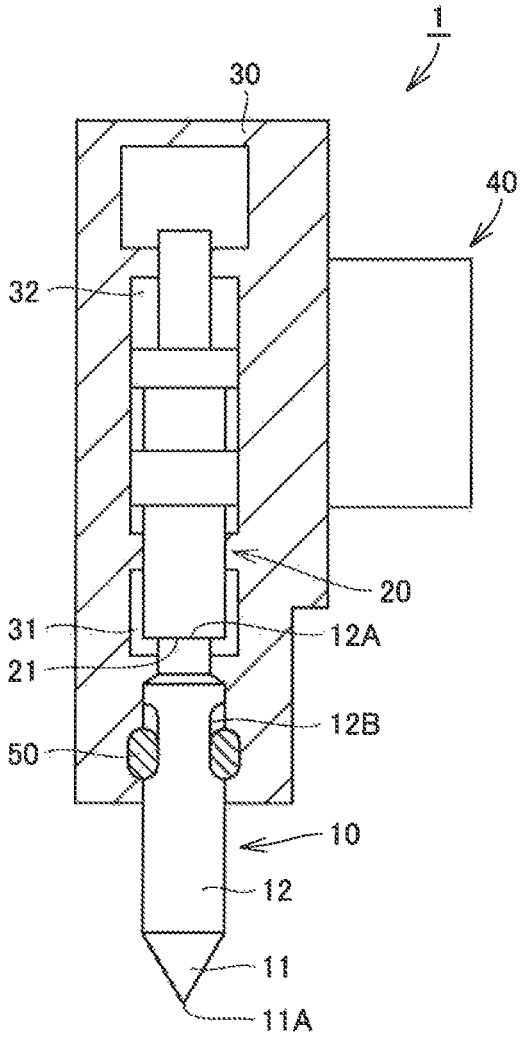
FIG. 1 is a cross-sectional view schematically illustrating a configuration of a hydraulic breaker.

An embodiment of the present invention will now be described. In the following drawings, the same or corresponding parts are denoted by the same reference numerals, and the description thereof will not be repeated.

A steel for a chisel according to this embodiment can be used as a material constituting a chisel included in a hydraulic breaker, which will be described as an example. FIG. 1 is a cross-sectional view schematically illustrating a configuration of a hydraulic breaker. With reference to FIG. 1, a hydraulic breaker 1 according to this embodiment includes a chisel 10, a piston 20, and a frame 30.

The chisel 10 has a rod shape. The chisel 10 includes a cylindrical base part 12 and a tapered part 11 which is connected to the base part 12 and whose cross sectional area taken vertically to the axial direction decreases toward the front end 11A. A proximal flat part 12A that is a flat part intersecting the axis axial direction is provided at a proximal end opposite to the front end 11A in the axial direction. An end of the chisel 10 close to the proximal flat part 12A in the axial direction is surrounded by the frame 30, and an end of the chisel 10 close to the front end 11A projects from the frame 30. A recess 12B is formed in a region of the chisel 10 surrounded by the frame 30. A stopper pin 50 is disposed in a region of an inner peripheral surface of the frame 30 corresponding to the recess 12B.

The piston 20 has a rod shape. The piston 20 is disposed in a region surrounded by the frame 30. The piston 20 is disposed coaxially with the chisel 10. A distal flat part 21 that is a flat part intersecting the axial direction is formed at the distal end of the piston 20. The chisel 10 and the piston 20 are disposed in such a manner that the distal flat part 21 of the piston 20 faces the proximal flat part 12A of the chisel. The piston 20 is held to be axially movable relative to the frame 30.

The piston 20 moves in the axial direction to strike the chisel 10 so that a striking force is transmitted to the chisel 10. In a hit chamber 31 defined at the inner periphery of the frame 30, contact of the distal flat part 21 of the piston 20 with the proximal flat part 12A of the chisel 10 causes a striking force to be transmitted from the piston 20 to the chisel 10. The chisel 10 breaks rocks or the like by the transmitted striking force.

An oil chamber 32 that receives hydraulic oil for driving the piston 20 is defined between the piston 20 and the frame 30. A control valve mechanism 40 is disposed on a side surface of the frame 30. Supply of hydraulic oil from the control valve mechanism 40 to the oil chamber 32 causes the piston 20 to be driven in the axial direction and hit the chisel 10. The chisel 10 breaks rocks or the like by the striking force transmitted from the piston 20.

In a case where the thus-configured chisel 10 is used under a severe environment, the temperature near the front end 11A thereof increases to about 600° C. In the chisel 10 to be used in such an environment, the hardness and the impact value after tempering at a high temperature (600° C.) are increased, and the hardness of the core portion after tempering (after tempering at 210° C.) performed for removing strains in quenching is increased. In this manner, abrasion resistance and cracking resistance can be increased, and thereby, high durability can be obtained. The chisel 10 according to this embodiment is constituted by a steel for a chisel including 0.40% by mass or more and 0.45% by mass or less of carbon, 0.50% by mass or more and 0.80% by mass or less of silicon, 1.00% by mass or more and 1.30% by mass or less of manganese, 0.001% by mass or more and 0.005% by mass or less of sulfur, 2.90% by mass or more and 3.80% by mass or less of chromium, and 0.20% by mass or more and 0.40% by mass or less of molybdenum, with a balance consisting of iron and an unavoidable impurity, and an ideal critical diameter DI defined by Equation (1) is 600 or more.

The chisel 10 according to this embodiment constituted by the steel described above has a hardness of 32 HRC or more in the surface at room temperature after heating to 600° C. and an impact value of 80 J/cm$^2$ or more in a region including the surface. In the chisel 10, the hardness of the core portion (hardness after tempering for reducing strains after quenching) is 45 HRC or more. Thus, the chisel 10 according to this embodiment has high durability under severe environments.

In the steel for a chisel constituting the chisel 10, the value of $\alpha$ defined by Equation (2) may be 2.0 or more and 2.4 or less. In this case, high levels of the hardness and the impact value after high-temperature tempering can be obtained, and durability of the chisel 10 can be further enhanced.

In the steel for a chisel constituting the chisel 10, the content of phosphorus included as an impurity is preferably 0.020% by mass or less. In this case, the influence of phosphorus on toughness can be reduced. The content of phosphorus is more preferably 0.015% by mass or less. This can increase the impact value after high-temperature tempering, and further increase cracking resistance of the steel for a chisel.

Figure 2:
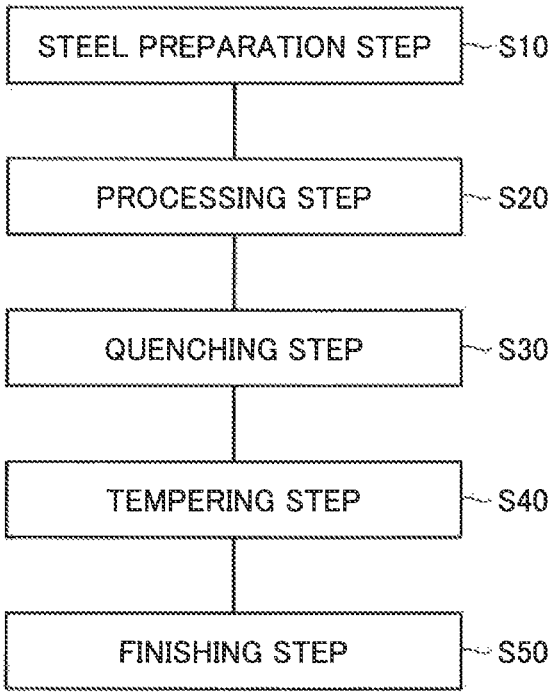
FIG. 2 is a flowchart schematically showing a process of producing a chisel.

An example method for producing the chisel 10 will now be described with reference to FIG. 2. FIG. 2 is a flowchart schematically showing a process of producing a chisel. In the method for producing the chisel 10 according to this embodiment, a steel material preparation step is performed as step (S10). In this step (S10), a solid cylindrical steel material having the composition of the steel for a chisel described above is prepared, for example.

A processing step is performed as step (S20). In this step (S20), processing such as cutting is performed on the steel material prepared in step (S10). In this manner, the material is processed into a general shape of the chisel 10 according to this embodiment.

Next, a quenching step is performed as step (S30). In this step (S30), the formed body obtained in step (S20) is subjected to quenching. The quenching is performed in such a manner that the formed body heated to a temperature of about 870° C. in an atmospheric furnace is subjected to oil cooling or water cooling, for example.

Thereafter, a tempering step is performed as step (S40). In this step (S40), tempering is performed on the formed body subjected to quenching in step (S30). The tempering is performed in such a manner that the formed body heated to 210° C. in a heating furnace is subjected to air cooling.

A finishing step is performed as step (S50). In this step (S50), a finishing process such as cutting, grinding, shot blasting, or coating is performed on the formed body subjected to tempering in step (S40) as necessary. Through the foregoing procedure, the chisel 10 according to this embodiment can be produced.

As described above, a steel material constituted by a steel for a chisel having the composition described above is processed to obtain a formed body, and the formed body is subjected to the heat treatment and then to the finishing treatment as necessary, thereby obtaining the chisel 10 according to this embodiment. Even if this chisel 10 is used under such a severe environment that the chisel is tempered by heating to have its distal temperature increase to about 600° C., the chisel 10 can obtain high abrasion resistance and high cracking resistance.

Examples

Experiments were performed to observe compositions suitable for a steel for a chisel to be used under severe environments. The experiments were conducted in the following procedure.

First, steel materials having compositions shown in Table 1 below were prepared. The steel materials were quenched by rapidly cooling from 870° C., and then heated to 200° C. to be subjected to tempering, thereby producing samples. In anticipation of use environments of chisels, the samples were heated to 600° C. to be subjected to tempering. The hardnesses and impact values of the resulting samples were measured. The hardnesses were measured with a Rockwell hardness tester. The impact values were measured with a 2-mm V-notch Charpy impact test (sample shape: a length of 55 mm; a square cross section of 10 mm at each side; a notch depth of 2 mm; a notch angle of 45°; and a notch bottom radius of 0.25 mm).

Table 1 provides a listing of values of carbon (C), silicon (Si), manganese (Mn), phosphorus (P), sulfur (S), chromium (Cr), molybdenum (Mo), niobium (Nb), vanadium (V), titanium (Ti), and boron (B) of each steel in units of % by mass. The balance consists of iron and one or more unavoidable impurities. Although phosphorus is an unavoidable impurity, but is included in the table in consideration of a large influence on the impact value. Table 1 also shows hardnesses (HRC) and impact values (unit: J/cm$^2$) obtained through the examples described above. Table 1 also shows values of the ideal critical diameter DI defined by Equation (1). Table 1 also shows values of α defined by Equation (2).

TABLE 1

| | C | Si | Mn | P | S | Cr | Mo | Nb | V | Ti | B | Hardness (HRC) | Impact value (J/cm$^2$) | DI value | α value |
|---|---|---|---|---|---|---|---|---|---|---|---|---|---|---|---|
| A | 0.44 | 0.71 | 1.11 | 0.014 | 0.003 | 3.51 | 0.30 | — | — | — | — | 34 | 112 | 693 | 2.38 |
| B | 0.40 | 0.69 | 1.18 | 0.014 | 0.002 | 3.73 | 0.35 | — | — | — | — | 33 | 129 | 787 | 2.04 |
| C | 0.42 | 0.74 | 1.08 | 0.013 | 0.005 | 3.45 | 0.27 | — | — | — | — | 33 | 108 | 626 | 2.38 |
| D | 0.43 | 0.78 | 1.24 | 0.013 | 0.003 | 3.01 | 0.28 | — | — | — | — | 34 | 122 | 652 | 2.26 |
| E | 0.45 | 0.67 | 1.10 | 0.012 | 0.002 | 3.36 | 0.31 | — | — | — | — | 35 | 91 | 665 | 2.35 |
| F | 0.41 | 0.49 | 1.09 | 0.015 | 0.003 | 1.01 | 0.40 | 0.03 | — | 0.04 | 0.002 | 33 | 97 | 253 | 1.71 |
| G | 0.47 | 0.92 | 1.01 | 0.015 | 0.009 | 3.85 | 0.26 | — | — | — | — | 35 | 45 | 736 | 3.26 |
| H | 0.41 | 1.01 | 1.29 | 0.015 | 0.003 | 1.51 | 0.24 | — | — | 0.04 | 0.002 | 35 | 38 | 383 | 2.71 |
| I | 0.41 | 1.00 | 2.00 | 0.015 | 0.003 | 1.50 | 0.02 | — | — | 0.04 | 0.002 | 33 | 11 | 336 | 1.04 |
| J | 0.41 | 1.01 | 1.30 | 0.015 | 0.003 | 2.80 | 0.02 | — | — | 0.04 | 0.002 | 34 | 11 | 389 | 2.47 |
| K | 0.29 | 0.20 | 1.80 | 0.015 | 0.010 | 1.36 | 0.44 | — | — | — | — | 29 | 199 | 367 | −1.21 |
| L | 0.44 | 0.26 | 0.35 | 0.008 | 0.008 | 1.98 | 1.02 | 0.03 | 0.11 | — | 0.003 | 45 | 47 | 317 | 3.22 |
| M | 0.37 | 0.30 | 1.33 | 0.015 | 0.013 | 0.62 | 0.13 | — | — | 0.04 | 0.002 | 30 | 122 | 117 | 0.09 |
| N | 0.42 | 0.25 | 0.82 | 0.008 | 0.009 | 0.94 | 0.15 | — | — | — | — | 30 | 137 | 110 | 1.27 |

Figure 3:
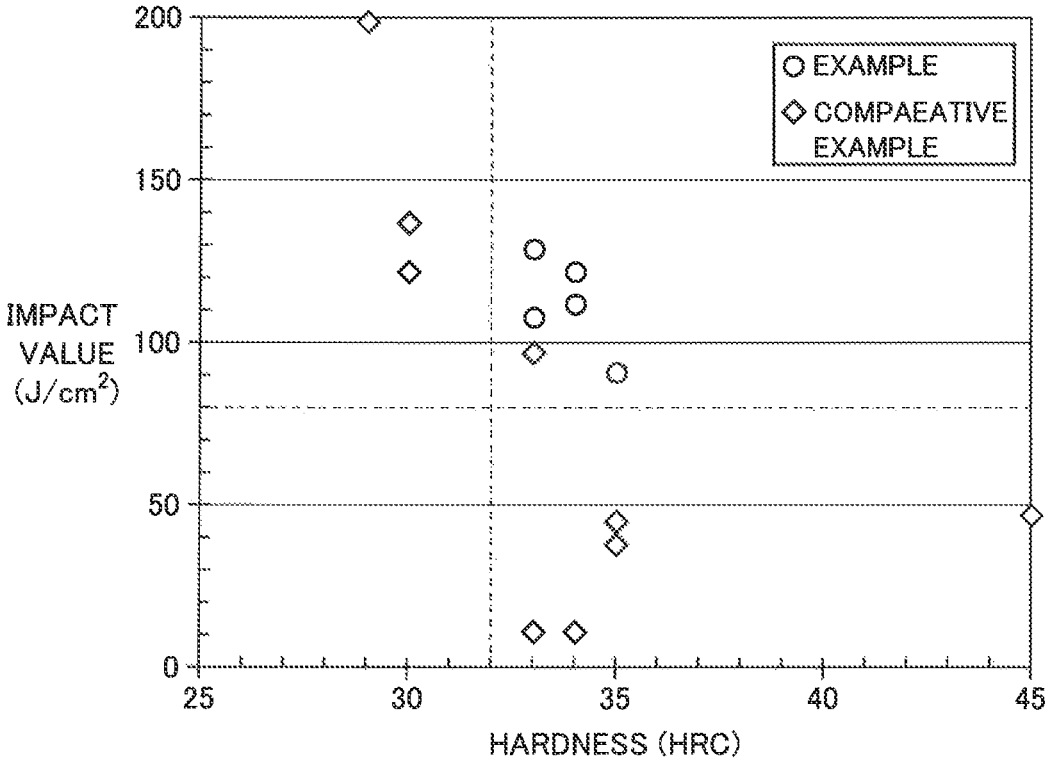
FIG. 3 is a graph showing a relationship between a sample hardness and an impact value.

Materials A through E in Table 1 are steels for chisels of the present invention (examples), and materials F through N are steels falling outside the scope of the present invention (comparative examples). FIG. 3 shows relationships between the hardness and the impact value of samples obtained from the steels. In FIG. 3, the abscissa represents the hardness at room temperature after tempering at 600° C., and the ordinate represents the impact value at room temperature after tempering at 600° C. In FIG. 3, data points of the samples of the examples are plotted as circles, and data points of the samples of the comparative examples are plotted as diamonds.

With reference to Table 1 and FIG. 3, materials A through E as steels for chisels of the present invention obtained hardnesses of 32 HRC or more and impact values of 80 J/cm$^2$ or more, which are target values after tempering at 600° C. The materials of the comparative examples having a values outside the range from 2.0 to 2.4, both inclusive, showed hardnesses and impact values less than the target values, except for material F. On the other hand, the materials of the examples having values of a within the range from 2.0 to 2.4, both inclusive, obtained target values of both the hardness and the impact value. Material F had a DI value less than a target value of 600. Material F showed insufficient hardenability.

In addition, an experiment for confirming a hardness in the core portion in the case of producing chisels was carried out. First, solid cylindrical steel materials having a diameter of 160 mm and compositions shown in Table 2 below were prepared. The steel materials were quenched and then heated to 210° C. to be subjected to tempering, thereby producing samples. For Example A, quenching was carried out by performing oil cooling from 880° C. For Example B, quenching was carried out by performing water cooling from 880° C. For Comparative Examples A and B, quenching was carried out by performing water cooling from 870°

C. Comparative Examples A and B have compositions similar to those of materials N and M in Table 1. The compositions of materials N and M correspond to compositions of steels currently used as steels for chisels.

TABLE 2

| | C | Si | Mn | P | S | Cr | Mo | B | DI value | α value |
|---|---|---|---|---|---|---|---|---|---|---|
| Example A | 0.42 | 0.74 | 1.10 | 0.013 | 0.003 | 3.45 | 0.31 | — | 680 | 2.40 |
| Example B | 0.42 | 0.73 | 1.08 | 0.014 | 0.002 | 3.48 | 0.28 | — | 642 | 2.39 |
| Comparative Example A | 0.39 | 0.23 | 0.77 | 0.012 | 0.016 | 1.09 | 0.20 | — | 123 | 1.14 |
| Comparative Example B | 0.37 | 0.30 | 1.31 | 0.015 | 0.012 | 0.61 | 0.12 | 0.002 | 112 | 0.13 |

Figure 4:
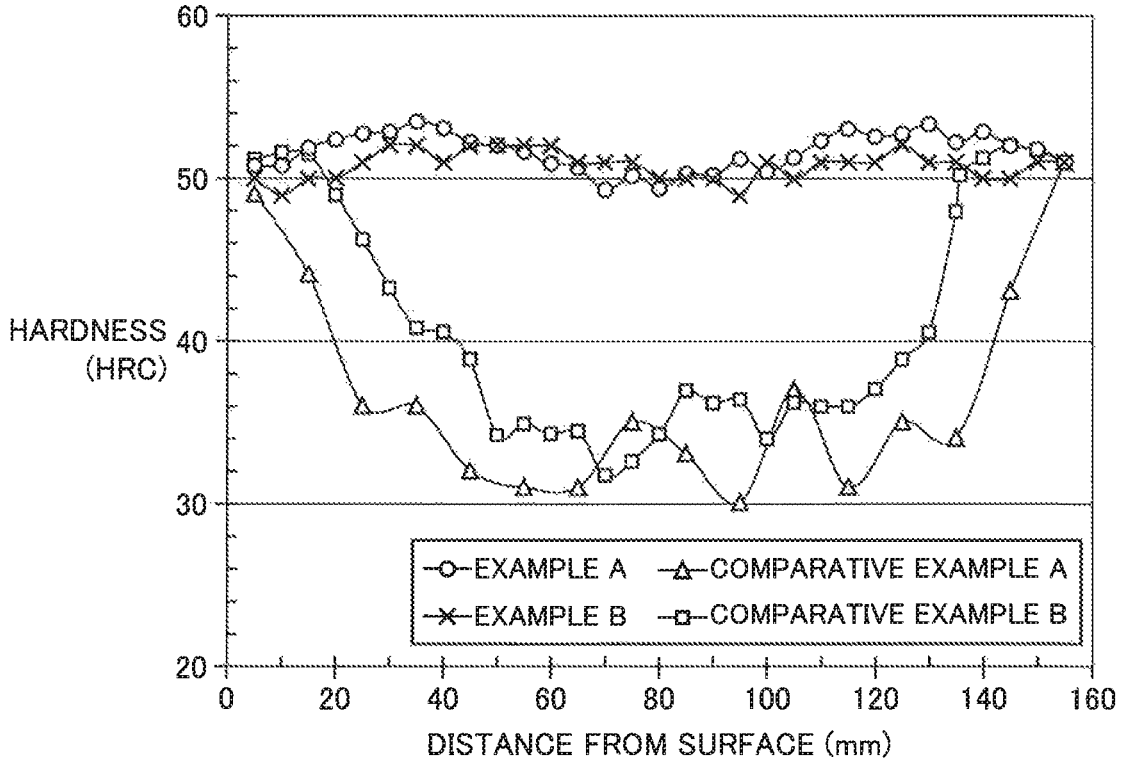
FIG. 4 is a graph showing a distribution of hardness of a sample in a radial direction.

Then, a hardness distribution in a cross section vertical to the axial direction of each sample was measured. The hardness measurement was carried out with a Rockwell hardness tester. FIG. 4 shows results of the measurement.

In FIG. 4, the abscissa represents the distance from the surface, and the ordinate represents the hardness. With reference to FIG. 4, in steels of the comparative examples that are currently used steels and have DI values less than 600, only surface portions are sufficiently hardened by quenching, but core portions are insufficiently hardened by quenching. The hardnesses in the core portions are below 45 HRC. On the other hand, in the steels of the examples having DI values of 600 or more, regions from surface portions to core portions are sufficiently hardened by quenching. Although Example A was subjected to oil quenching, Example A shows a hardness distribution substantially equivalent to that of Example B subjected to water quenching. The hardnesses in core portions of Examples A and B are 45 HRC or more. In the entire region of each cross section, the hardness is within the range from 49 to 54 HRC. Examples A and B show uniform hardness distributions.

From the foregoing results of the experiments, it was confirmed that steels for chisels according to the present invention can obtain high abrasion resistance and cracking resistance even when used in a severe environment, and thus, show high durability. With reference to FIG. 1, the steel for a chisel can also be used as a steel constituting the stopper pin 50.

It should be understood that the embodiment and examples disclosed herein are illustrative and non-restrictive in every respect. The scope of the present invention is defined by the terms of the claims, rather than the description above, and is intended to include any modifications within the scope and meaning equivalent to the terms of the claims.

A chisel and a steel for a chisel according to the present invention are applicable particularly advantageously as a chisel to be used in severe environments and a material for such a chisel.

DESCRIPTION OF REFERENCE NUMERALS

1: hydraulic breaker, 10: chisel, 11: tapered part, 11A: front end, 12: base part, 12A: proximal flat part, 12B: recess, 20: piston, 21: distal flat part, 30: frame, 31: hit chamber, 32: oil chamber, 40: control valve mechanism, and 50: stopper pin.

The invention claimed is:

1. A steel body constituting by a steel consisting of:

0.40% by mass or more and 0.45% by mass or less of carbon (C);

0.50% by mass or more and 0.80% by mass or less of silicon (Si);

1.00% by mass or more and 1.30% by mass or less of manganese (Mn);

0.001% by mass or more and 0.005% by mass or less of sulfur (S);

2.90% by mass or more and 3.80% by mass or less of chromium (Cr);

0.20% by mass or more and 0.40% by mass or less of molybdenum (Mo); and a balance consisting of iron and one or more unavoidable impurities with 0.020% by mass or less of phosphorous (P), wherein the steel has an ideal critical diameter DI defined by Equation (1) of 600 or more:

$$DI = 7\cdot(\%C)^{\frac{1}{2}}\cdot(1+0.64\cdot\%Si)\cdot(1+4.1\cdot\%Mn)\cdot(1+2.83\cdot\%P)\cdot(1-0.62\cdot\%S)\cdot(1+2.33\cdot\%Cr)\cdot(1+3.14\cdot\%Mo)$$

wherein % is by mass, and wherein the steel body is a rod having a diameter of at least 150 mm, and a hardness (HRC) of an entire cross section of the steel body is within the range of from 49 to 54 HRC.

2. The steel body according to claim 1, wherein a value of α defined by Equation (2) is 2.0 or more and 2.4 or less:

$$\alpha=5\cdot\%C+3\cdot\%Si+\%Mo-2\cdot\%Mn-10\cdot\%S \quad (2)$$ where % is by mass.

3. The steel body according to claim 1, wherein sulfur (S) is present at 0.001% by mass or more and 0.004% by mass or less.

4. The steel body according to claim 1, wherein the steel has 3.01% by mass or more and 3.80% by mass or less of chromium (Cr).

5. The steel body according to claim 1, wherein the steel has 3.36% by mass or more and 3.80% by mass or less of chromium (Cr).

6. The steel body according to claim 1, wherein the steel has 0.27% by mass or more and 0.40% by mass or less of molybdenum (Mo).

7. The steel body according to claim 1, wherein the steel body is a rod having a diameter of at least 160 mm.

8. A chisel constituted by a steel consisting of:

0.40% by mass or more and 0.45% by mass or less of carbon (C);

0.50% by mass or more and 0.80% by mass or less of silicon (Si);

1.00% by mass or more and 1.30% by mass or less of manganese (Mn);

0.001% by mass or more and 0.005% by mass or less of sulfur (S);

2.90% by mass or more and 3.80% by mass or less of chromium (Cr);

0.20% by mass or more and 0.40% by mass or less of molybdenum (Mo); and a balance consisting of iron and one or more unavoidable impurities with 0.020% by mass or less of phosphorous (P), wherein the steel has an ideal critical diameter DI defined by Equation (1) of 600 or more:

$$DI = 7 \cdot (\%C)^{\frac{1}{2}} \cdot (1 + 0.64 \cdot \%Si) \cdot (1 + 4.1 \cdot \%Mn) \cdot (1 + 2.83 \cdot \%P) \cdot (1 - 0.62 \cdot \%S) \cdot (1 + 2.33 \cdot \%Cr) \cdot (1 + 3.14 \cdot \%Mo)$$

wherein % is by mass, and wherein the chisel has a diameter of at least 150 mm, and a hardness (HRC) of an entire cross section of the chisel vertical to an axial direction of the chisel is within the range of from 49 to 54 HRC.

9. The chisel according to claim 8, wherein a value of α defined by Equation (2) is 2.0 or more and 2.4 or less:

$$\alpha = 5 \cdot \%C + 3 \cdot \%Si + \%Mo - 2 \cdot \%Mn - 10 \cdot \%S \quad (2)$$

where % is by mass.

10. The chisel according to claim 8, wherein a hardness of a surface at room temperature after heating to 600° C. is 32 HRC or more, and a region including the surface has an impact value of 80 J/cm$^2$ or more.

11. The chisel according to claim 8, wherein sulfur (S) is present at 0.001% by mass or more and 0.004% by mass or less.

12. The chisel according to claim 8, wherein the steel has 3.01% by mass or more and 3.80% by mass or less of chromium (Cr).

13. The chisel according to claim 8, wherein the steel has 3.36% by mass or more and 3.80% by mass or less of chromium (Cr).

14. The chisel according to claim 8, wherein the steel has 0.27% by mass or more and 0.40% by mass or less of molybdenum (Mo).

15. The chisel according to claim 8, having a diameter of at least 160 mm.

* * * * *